US008539632B2

(12) United States Patent
Kraemer

(10) Patent No.: US 8,539,632 B2
(45) Date of Patent: Sep. 24, 2013

(54) TOOTHBRUSH

(75) Inventor: Hans Kraemer, Buehl (DE)

(73) Assignee: GlaxoSmithKline Consumer Healthcare GmbH & Co KG, Buehl (Baden) (DE)

( * ) Notice: Subject to any disclaimer, the term of this patent is extended or adjusted under 35 U.S.C. 154(b) by 1018 days.

(21) Appl. No.: 12/376,872

(22) PCT Filed: Aug. 9, 2007

(86) PCT No.: PCT/EP2007/058262

§ 371 (c)(1), (2), (4) Date: Feb. 9, 2009

(87) PCT Pub. No.: WO2008/017703

PCT Pub. Date: Feb. 14, 2008

(65) Prior Publication Data

US 2009/0313779 A1 Dec. 24, 2009

(30) Foreign Application Priority Data

Aug. 11, 2006 (GB) ..... 0616032.9
Dec. 5, 2006 (GB) ..... 0624319.0

(51) Int. Cl.
*A46B 9/04* (2006.01)

(52) U.S. Cl.
USPC ..... 15/167.1; 15/172; 15/201

(58) Field of Classification Search
USPC ..... 15/167.1, 172, 201
See application file for complete search history.

(56) References Cited

U.S. PATENT DOCUMENTS

| | | | | |
|---|---|---|---|---|
| 5,105,499 | A | 4/1992 | Dirksing | |
| 5,765,254 | A * | 6/1998 | O'Halloran | 15/167.1 |
| 5,987,690 | A * | 11/1999 | Heuler | 15/167.1 |
| 6,003,189 | A * | 12/1999 | Falleiros | 15/167.1 |
| 6,357,074 | B1 | 3/2002 | Weihrauch | |
| 6,514,445 | B1 | 2/2003 | Cann | |
| 2001/0014991 | A1 | 8/2001 | Halm | |

FOREIGN PATENT DOCUMENTS

| | | | |
|---|---|---|---|
| DE | 29820734 | U1 | 3/2000 |
| DE | 102005008199 | | 8/2006 |
| EP | A-0 454 625 | | 4/1991 |
| WO | WO-89/10076 | A | 11/1989 |
| WO | WO92/17093 | A | 10/1992 |
| WO | WO97/07707 | A | 3/1997 |
| WO | WO-00/65953 | A | 11/2000 |
| WO | WO02/11582 | A | 2/2002 |
| WO | WO2005/084486 | A | 9/2005 |
| WO | WO2005/107522 | A | 11/2005 |
| WO | WO2006/089784 | A | 8/2006 |
| WO | WO2006/131397 | A | 12/2006 |

* cited by examiner

*Primary Examiner* — Lee D Wilson
*Assistant Examiner* — Shantese McDonald
(74) *Attorney, Agent, or Firm* — Joshua C. Sanders; Theodore R. Furman

(57) ABSTRACT

A toothbrush with a cleaning zone with bristles, and with a deformable element by which the cleaning zone can be adapted to the shape of the tooth surface by the cleaning force, where the deformable element comprises flexible wings tapering in a wedge shape toward the cleaning zone and with guide elements between them, at least one of the wings and/or guide element is made of a compressible elastic material.

13 Claims, 7 Drawing Sheets

Figure 3:
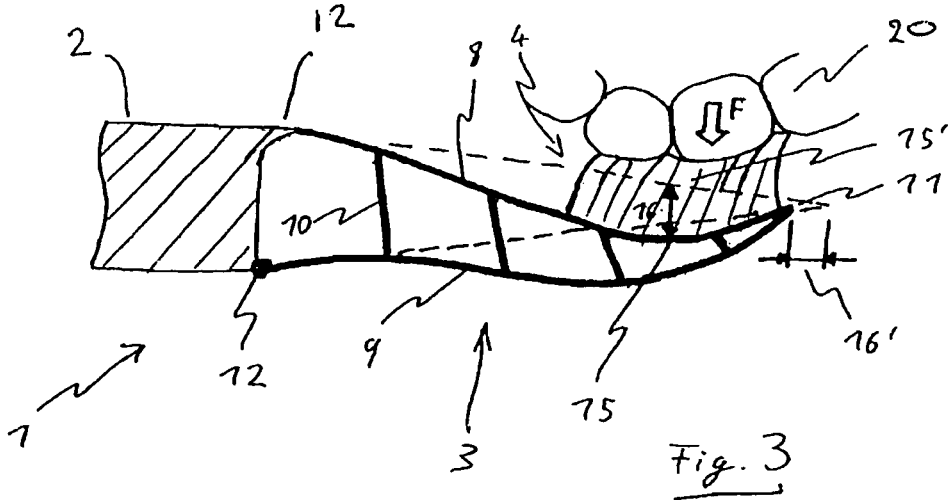

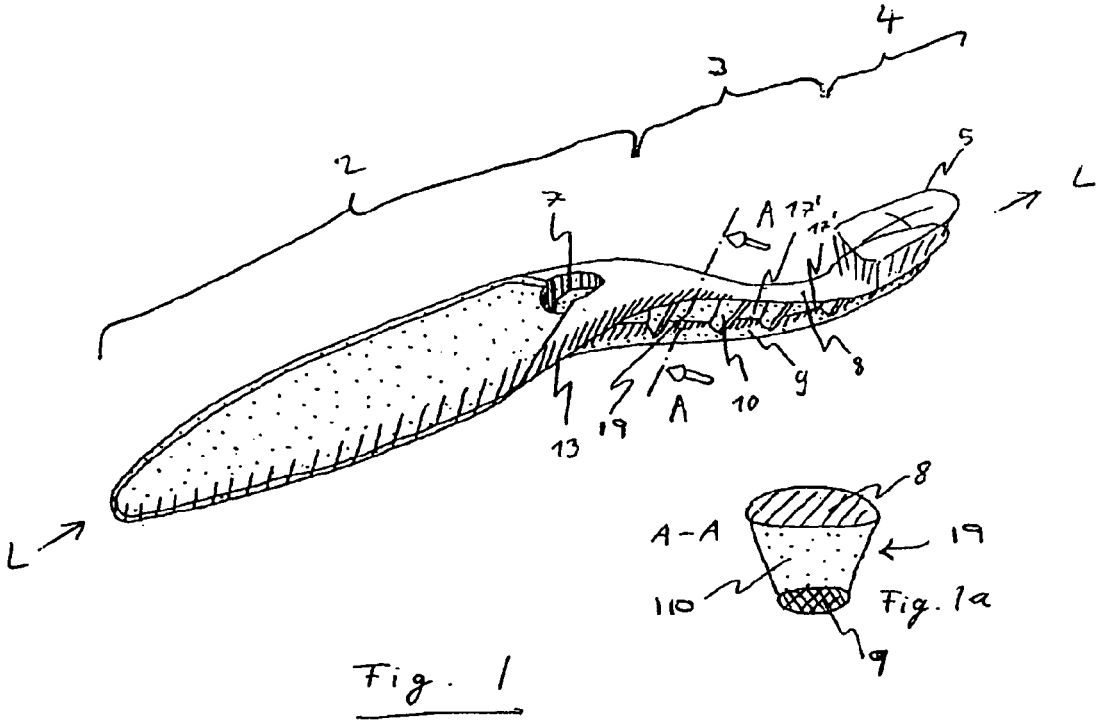
Fig. 1a
Fig. 1
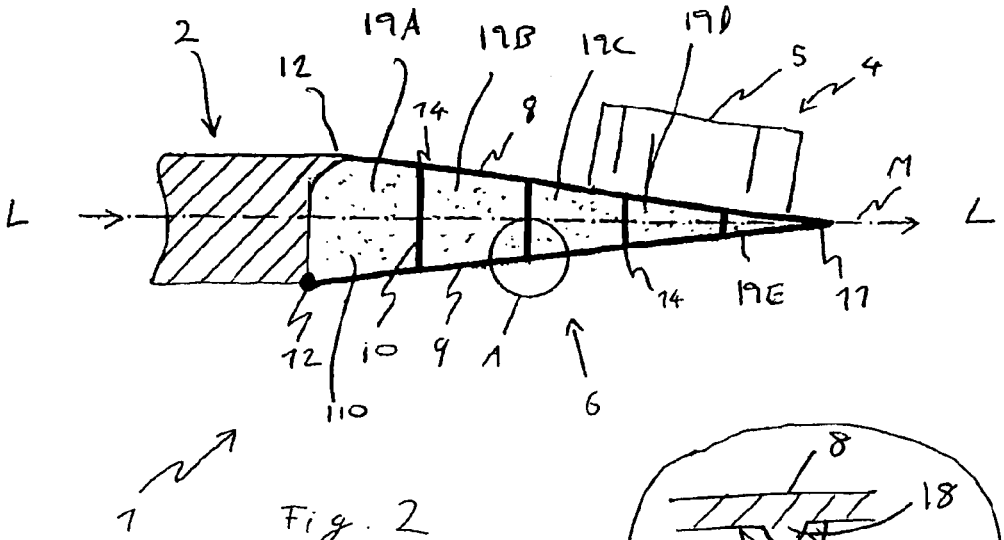
Fig. 2
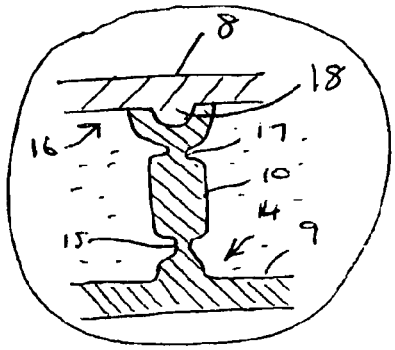
Fig. 2A

TOOTHBRUSH

This application is a 371 national phase entry of International Application No. PCT/EP07/58262, filed Aug. 9, 2007, which claims the priority of GB Appn. Nos. 0616032.0 and 0624319.0, filed Aug. 11, 2006 and Dec. 5, 2006, which are incorporated herein in their entirety.

This invention relates to toothbrushes. Toothbrushes are well known devices generally comprising a grip handle by which the toothbrush is held, and a cleaning zone (commonly known as a "head") on which tooth-cleaning elements (herein termed generically "bristles") are arranged, and which are pressed with a cleaning force against the teeth during cleaning. The head and handle define a toothbrush longitudinal handle-head direction, with a neck longitudinally between the head and handle. Bristles normally project from the cleaning zone in a direction transverse to the longitudinal direction, termed herein the "bristle direction", because bristles are the most common type of cleaning element.

In particular this invention relates to a toothbrush with a cleaning zone on which tooth-cleaning elements are arranged, and with a deformable element by which the cleaning zone can be adapted to the shape of the tooth surface by the cleaning force, where the deformable element has at least a first flexible wing facing towards the cleaning zone and a second such wing facing away from the cleaning zone, and also at least one guide element, and where the first and second wings are held together moveably by the guide element.

Such a toothbrush is known for example from WO-A-2006/089784, the disclosure of which forms the basis of the pre-characterising part of the present claims relating to one aspect of the present invention.

The present invention is based on the problem of improving this and other known toothbrushes which cleans the teeth more effectively, typically by better adaptation to the tooth surfaces, and at the same time more gently than known toothbrushes.

According to a first aspect of this invention there is provided a toothbrush with at least one cleaning zone on which bristles are arranged, to be pressed against the teeth during use with a cleaning force, and with at least one deformable element by which the cleaning zone can be adapted to the shape of the tooth surface by the cleaning force, where the deformable element has at least a first flexible wing arranged relatively closer to the cleaning zone and a second such wing arranged relatively further away from the cleaning zone, and also at least one guide element, and where the first and second wings are held together moveably by the guide element, the wings forming a wedge, being closer together at one end and further distanced from each other at the other end, characterised in that at least one of said wings, and/or at least one guide element is made of a compressible elastic material.

Preferably the wings form a wedge in which they are joined together at a point relatively further from the handle, and are further distanced from each other at a point relatively closer to the handle. In such a construction the wedge-shape tapers in the longitudinal direction from the handle, narrowing toward the cleaning zone.

In this surprisingly simple solution the cleaning zone of the toothbrush according to the invention astonishingly moulds itself to the surfaces of the teeth during brushing, so that the bristles also penetrate into the interdental spaces and can remove the plaque located there more effectively. In enabling novel deformation modes the flexibility characteristics of the toothbrush of the invention may also improve access to the teeth in other ways.

As a result of the cleaning force during brushing, which is exerted as a counterforce by the tooth on the wing, the wing and thus also the cleaning zone may be caused to curve concavely around an individual tooth, plural teeth or the dental arch. Thus in the solution according to the invention an optimally adapted cleaning zone with individually arranged cleaning elements is created for each section of the user's teeth. As a result of the solution according to the invention the cleaning zone adapts to the shape of an opposite surface, which when brushing the teeth is the teeth to be cleaned.

As the cleaning force applied by the user adapts the cleaning zone to the surfaces of the teeth, during brushing pressure is not necessarily exerted on specific points of the surface of the teeth but over the whole cleaning zone. This means that the teeth may be cleaned particularly gently.

Compared with the known toothbrushes which have a spring element in the handle area and thus a change in the angle of the handle during brushing, the solution according to the invention has the advantage that the unbent toothbrush according to the invention is easier to control during brushing.

For example the feature that one of said wings is made of a plastics material and another of said wings is made of a compressible elastic material and/or at least one of said guide elements is made of a compressible elastic material improves the flexibility characteristics of the toothbrush relative to the toothbrush of WO-A-2006/089784.

The toothbrush of the invention can be developed further in various embodiments, as described below.

The said wings comprise longitudinally elongate members which are flexible at least in a plane which is parallel to the bristle direction. The toothbrush can be provided so that it can be moved from a resting position into a cleaning position by means of the cleaning force exerted on the cleaning zone, whereby in the cleaning position the cleaning zone bends towards the direction from which the cleaning force is being applied, compared with the resting position. This has the advantage that the cleaning zone adapts to the contour of a tooth and the cleaning elements adapt with the cleaning zone individually for each tooth. For example if pressure is applied by the cleaning force to a point on the cleaning zone the cleaning zone can tend to bend concavely around that point. The wings may be straight linear, or curved, and their thickness may be the same or vary along the length of the deformable region.

Suitably those of the wings or guide element which are not made of a compressible elastic material are made of a plastics material.

In one embodiment the first flexible wing arranged relatively closer to the cleaning zone is made of plastics material, and the second such wing arranged relatively further away from the cleaning zone is made of compressible elastic material.

In another embodiment the first flexible wing arranged relatively closer to the cleaning zone is made of compressible elastic material, and the second such wing arranged relatively further away from the cleaning zone is made of plastics material.

In another embodiment both the first flexible wing arranged relatively closer to the cleaning zone and the second wing arranged relatively further away from the cleaning zone are made of plastics material, and at least one of said guide elements is made of a compressible elastic material.

In another embodiment the first flexible wing arranged relatively closer to the cleaning zone is made of plastics material, and the second such wing arranged relatively further away from the cleaning zone is made of compressible elastic material, and at least one of said guide elements is made of a compressible elastic material.

In another embodiment the first flexible wing arranged relatively closer to the cleaning zone is made of compressible elastic material, and the second such wing arranged relatively further away from the cleaning zone is made of plastics material, and at least one of said guide elements is made of a compressible elastic material.

In another embodiment both the first flexible wing arranged relatively closer to the cleaning zone and the second such wing arranged relatively further away from the cleaning zone are made of compressible elastic material, and at least one of said guide elements is made of a compressible elastic material.

In another embodiment both the first flexible wing arranged relatively closer to the cleaning zone and the second such wing arranged relatively further away from the cleaning zone are made of compressible elastic material, and at least one of said guide elements is made of a plastics material.

In these embodiments suitably a wing and one or more guide element may be made integrally of the same compressible elastic material.

If one guide element is made of a compressible elastic material then preferably all of the guide elements may be made of the compressible elastic material. However the toothbrush may comprise one or more guide element made of plastics material and one or more guide element made of compressible elastic material.

The guide element comprises an element bridging between the said wings and connected to the wings at each end of the guide element. Plural guide elements are longitudinally spaced along the length of the deformable element. Such elements may bridge between the wings either perpendicular to the longitudinal direction, or at a non-perpendicular angle to the longitudinal direction, e.g. 45-90°. The number and longitudinal spacing of the guide elements does not appear to be critical, but more guide elements per unit length appears to enable the deformable element to bend in a smoother curve.

Preferably the guide element may be connected to one or both wing by a hinge. Such a hinge may for example comprise a region of the guide element which is thinned relative to an adjacent region of the guide element, for example a so-called live hinge. The bridging element may be connected to the wing in various ways appropriate to the materials involved. For example as mentioned above a guide element may be connected to a wing by means of integral construction of the wing and guide element. For example a guide element and a wing may be welded together. A guide element and wing of which one is made of plastics material and the other made of a compressible elastic material may be connected together by means of the known bonding which occurs between pairs of such materials, e.g. between compressible elastic materials which are thermoplastic elastomers and known plastics materials as used for toothbrushes such as polypropylene. When connection by such bonding is to be achieved it may be preferable to provide interface features which increase the area of contact between the two materials e.g. grooves, hollows, raised bumps or ridges on the surface of the plastics material.

Suitable plastics materials are those which are known for toothbrush manufacture, such as known polypropylenes. Such plastics materials are in practice considered incompressible under the kinds of pressures encountered in tooth brushing.

Suitable compressible elastic materials include thermoplastic elastomers (TPE's) of which many are known. To give the elastic a suitable strength and rigidity, an elastic material with a hardness of Shore D 100 or more, preferably Shore D 140 or more is preferred, e.g. up to Shore D 150. However the elasticity of the material even at this hardness provides advantageous compression and tension characteristics of the toothbrush of the invention.

Between the wings, e.g. in the interstices between the guide elements there is a space. In this space there may be a further flexible material, for example a second compressible elastic material which is less rigid than the above-mentioned compressible elastic material of which a wing or guide element is made.

Such a space may be defined in various ways. The guide element can comprise a dividing wall and can divide the space into at least two separate sections, one or more or all of which can be filled at least partially with such a further material. Such a further material is preferably a further compressible elastic material. Such a further elastic material is preferably as soft as can be practically achieved, for example with a hardness of Shore A 5-20, preferably Shore A 10+/−2. Thermoplastic elastomer materials are suitable.

It is believed to be novel to provide a deformable element in a toothbrush which incorporates plural compressible elastic materials, one more rigid (e.g. harder and/or less flexible) and the other less rigid (e.g. softer and/or more flexible). The use of two such elastic materials facilitates the achievement of desired flexibility characteristics of the toothbrush of this invention.

Therefore in a second aspect of this invention there is provided a toothbrush with at least one cleaning zone on which bristles are arranged, to be pressed against the teeth during use with a cleaning force, and with at least one deformable element by which the cleaning zone can be adapted to the shape of the tooth surface by the cleaning force, characterised in that the deformable element comprises a first flexible part made of a first, relatively more rigid, elastic material, and a second flexible part made of a second, relatively less rigid, elastic material.

In a first embodiment of this second aspect of the invention there may be two longitudinally extending flexible parts made of the first, relatively more rigid elastic material, and the second flexible part made of a second, relatively less rigid, elastic material may be located widthways between these two first flexible parts. Such first flexible parts may be connected together, e.g. moveably, by one or more guide element, which may be integrally made with the first flexible parts. Such first flexible parts may be longitudinally parallel, or may taper longitudinally, narrowing in the direction from the grip handle toward the cleaning zone.

Such longitudinally extending flexible parts may be in the form of the flexible wings of the first aspect of this invention.

The second, relatively less rigid, elastic material may be the above-mentioned further compressible elastic material of the first aspect of this invention.

Additionally or alternatively, such a space or section can contain a further material comprising a gel or fluid.

Thus the deformation of the toothbrush according to the invention caused by the cleaning force can be influenced and different types of toothbrushes can be produced simply by a different filling of the space with such a further material. The presence of such a material can additionally modify the properties, e.g. flexibility, of the deformable element and can for example help to prevent dirt and contamination entering the space. The filled space can be at least partially transparent outwards, e.g. by means of a transparent elastic, gel or fluid material, so that the deformable element is visible from outside, in order to allow visual control of the deformable element. Visual control makes it possible to check the condition of the deformable element. i.e. the guide elements and the tension or compression wing, and any damage can be seen by the user.

The length of the deformable element may vary according to the desired characteristics of the toothbrush.

Preferably the deformable element extends for the length of the toothbrush between the end of the grip handle closest to the head, and the end of the head closest to the grip handle, i.e. the region generally known as the "neck" of the toothbrush. Based on the typical dimensions of toothbrushes 3-5 longitudinally spaced guide elements may be suitable in such a length of neck.

The head of the toothbrush as connected or connectable to such a neck may be generally conventional. Such a head may itself be made flexible, for example according to known constructions for example as disclosed in WO-A-92/17093, WO-A-97/07707, WO-A-2005/084486, WO-A-2005/107522 or WO-A-2006/131397.

In an embodiment the deformable element can extend at least partially into the head, such that the head comprises a first flexible wing arranged relatively closer to the bristles and a second such wing arranged relatively further away from the bristles, and also at least one guide element, and where the first and second wings are held together moveably by the guide element, characterised in that the wings form a wedge, being closer together at one end and further distanced from each other at the other end. In one form of this embodiment one of said wings may be made of a plastics material and the other of said wings is made of a compressible elastic material, and/or at least one of said guide elements may made of a compressible elastic material. Between the wings of such a head there is a space, and such a space may be filled at least partially with a further material. The construction, materials of the wings, guide element(s) and further material are analogous to those described above.

In this last mentioned embodiment the first flexible wing of such a head arranged relatively closer to the bristles may comprise a plastics material plate in which are set the bristles. Such a plate may be made in a flexible construction. One way in which such a plate may be made in a flexible construction may be by means of the plate comprising one or more relatively thinned regions, e.g. one or more widthways aligned thinned region, such that the thinned region can function as a hinge. Conveniently, if the head of this embodiment includes a further material between the wings the bristles may extend through holes in such a plate so that the ends of the bristles distant from the ends which contact the teeth during cleaning are supported by, e.g. embedded in, the further material. This is particularly suitable when the further material is a compressible elastic material as described above. When supported by such a further compressible elastic material the bristles may advantageously bounce on such a material.

Construction of the head according to this embodiment has the advantage that the cleaning force is directed directly into the deformable element during brushing, and thus the deformation of the deformable element is transmitted directly to the cleaning zone.

The deformable element can additionally or alternatively be housed in a handle area of the toothbrush, at a distance from the cleaning zone. Thus the deformable element, connected in its effect with the cleaning zone, can also effect an advantageous deformation of the handle area.

In a further embodiment one or more elastic spring element working lengthwise can be created in at least one of the wings, to limit the relative deformability of the wings in relation to each other. The spring element absorbs the forces working in the tension or compression wing and changes the deformation of the deformable element. Such a spring element can for example be made of an elastic material which is added in a two-stage moulding process during injection moulding of the toothbrush. Also, at least one elastic spring element can be created in the guide element, which changes the deformation of the deformable element above a predetermined cleaning force, which can be varied by the design of the spring element.

In order to provide a toothbrush according to the invention with even greater deformation possibilities of the cleaning zone, the toothbrush can have several deformable elements. These can extend from the neck splayed out parallel to each other, in a star shape or in a helix from a pivotal point, for example in a rotatable brush head for an electric toothbrush, and form a joint cleaning zone. Also a deformable element can house a further deformable element.

In another embodiment the deformable element can have two wings closer to the cleaning zone and running essentially side by side and a wing further from the cleaning zone, whereby the guide element connects the wing further from the cleaning zone with the two wings closer to the cleaning zone. In this embodiment the cleaning zone can be arranged on both two wings closer to the cleaning zone and the guide element can be in a V-shape, for example. This embodiment has the advantage that the toothbrush twists if the cleaning force is exerted on only one two wings closer to the cleaning zone. Moreover such an embodiment can also have at least two guide elements, each connecting the compression wing with one of the two tension wings. Having a separate guide element for each two wings closer to the cleaning zone means that the cleaning force directed into one such wing is transmitted less strongly to the other tension wing.

The toothbrush according to the invention can have two deformable elements, the wings of which each span a plane, whereby these two planes run essentially at right angles to each other. This embodiment has the advantage that the toothbrush according to the invention is deformed by different cleaning forces working in different directions.

In order to achieve a different arrangement of the cleaning elements in the cleaning zone, the wings can be provided convex, concave or undulating to each other. The wings can also be of different lengths and give the deformable element a pre-curved shape.

The bristles in the cleaning zone can also be arranged parallel to each other or crossing. The bristles in the cleaning zone may extend perpendicular to the longitudinal direction or at a non-perpendicular angle to the longitudinal direction. The cleaning elements can also be arranged so that they cross in the cleaning position and thus further improve the cleaning properties of the toothbrush according to the invention. When the bristles are at non-zero angles to each other the bristle direction may be the average direction of the bristles.

The toothbrush of this invention can be made in various ways using conventional technology. For example in a first injection moulding operation the plastic material parts of the toothbrush may be made in a first mould as a plastic material "skeleton". Then this skeleton may be enclosed in a second injection mould with a cavity defining the shape of the compressible elastic material part(s), and the compressible elastic material part(s) may be made in a second injection moulding operation by injecting the compressible elastic material into the cavity using known temperature and pressure conditions which result in welding of the plastic material and compressible elastic material together.

If a further material is to be used in the toothbrush the product of this second operation, comprising plastic material and compressible elastic material parts, may be enclosed in a further injection mould with a cavity defining the shape of the further material part(s), and the further material part(s) may be made in a further injection moulding operation by injecting the further material into the cavity using known temperature and pressure conditions which result in welding of the further material and the plastic material and/or compressible elastic material together.

The toothbrush of the invention may be made in other ways. For example a plastic material "skeleton" may be made as above. The compressible elastic material part(s) may be made in a separate injection moulding operation. Then the plastic material part and compressible elastic material part(s) may be connected together for example by welding, adhesive, mechanical connection etc.

The invention will now be described by way of example only with reference to the accompanying. The various features can be combined or omitted independently of each other, as has already been stated above in relation to the individual advantageous embodiments.

The drawings show:

FIG. 1 a toothbrush according to the invention in a perspective, diagrammatic view.

FIG. 1A a cross-section along the line A-A of FIG. 1.

FIG. 2 a diagrammatic side view of the deformable element of the toothbrush of FIG. 1.

FIG. 2A an enlarged diagrammatic side view of the deformable element of the toothbrush of FIG. 1.

FIG. 3 a diagrammatic side view of the deformable element of FIG. 2 in a cleaning position.

Figure 4:
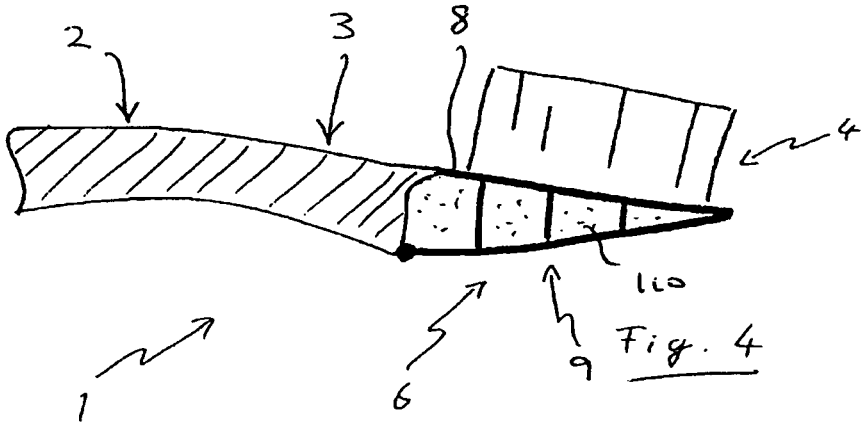

FIG. 4 a further example of a toothbrush of the invention.

Figure 5:
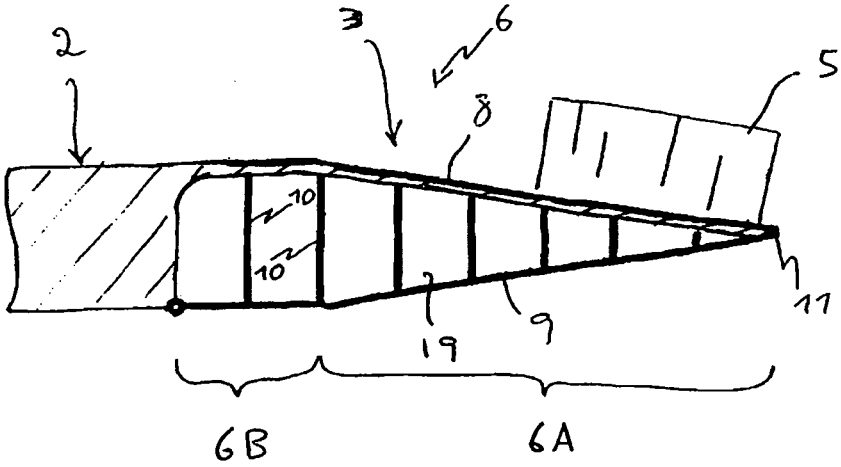

FIG. 5 a diagrammatic representation of the deformable element of a further example of a toothbrush of the invention.

Figure 6:
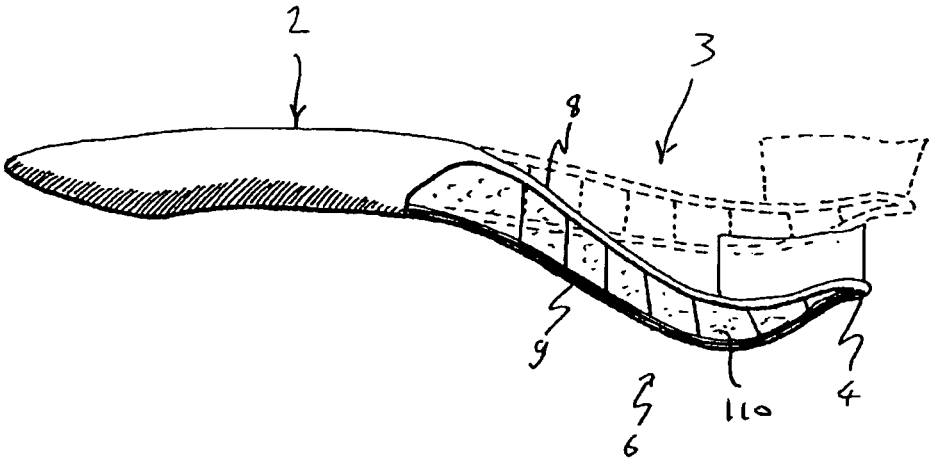

FIG. 6 a diagrammatic representation of the deformable element of a further example of a toothbrush of the invention.

Figure 7:
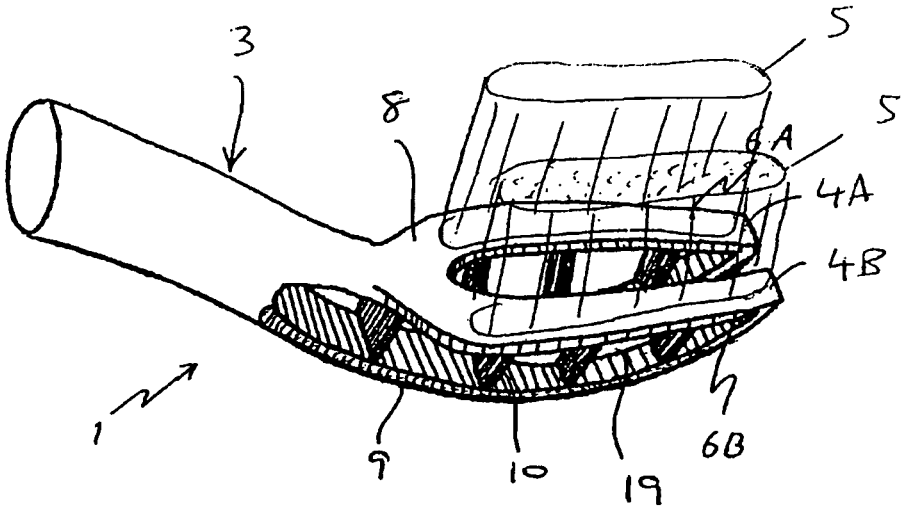

FIG. 7 a further example of a toothbrush of the invention.

Figure 8:
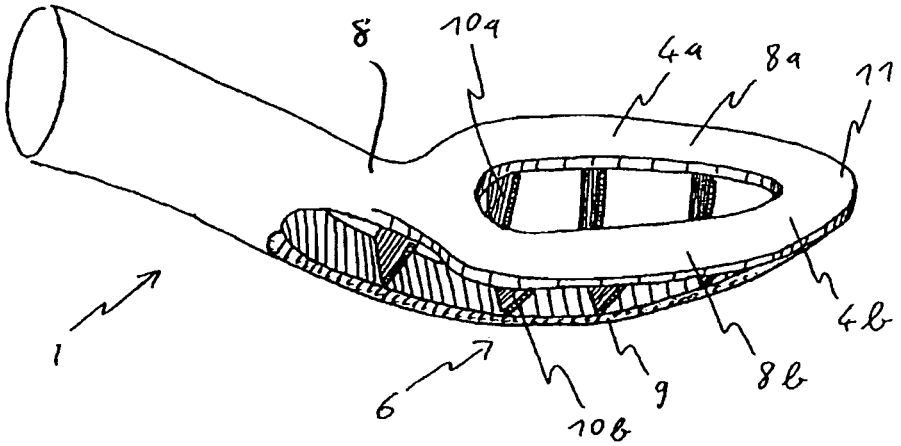

FIG. 8 a further example of a toothbrush of the invention

Figures 9, 9A, 9B:
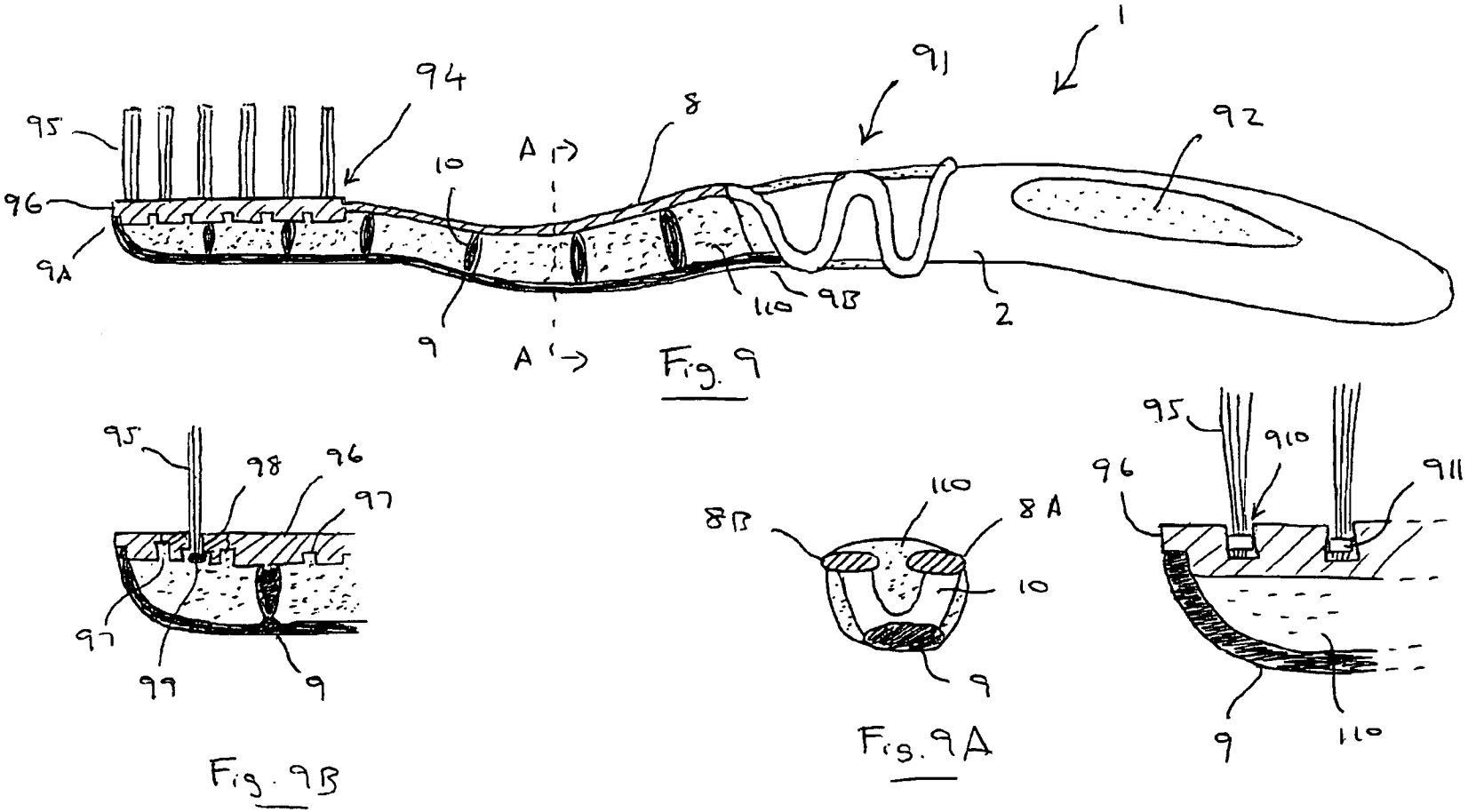

FIG. 9 a further example of a toothbrush of the invention

Figure 10:
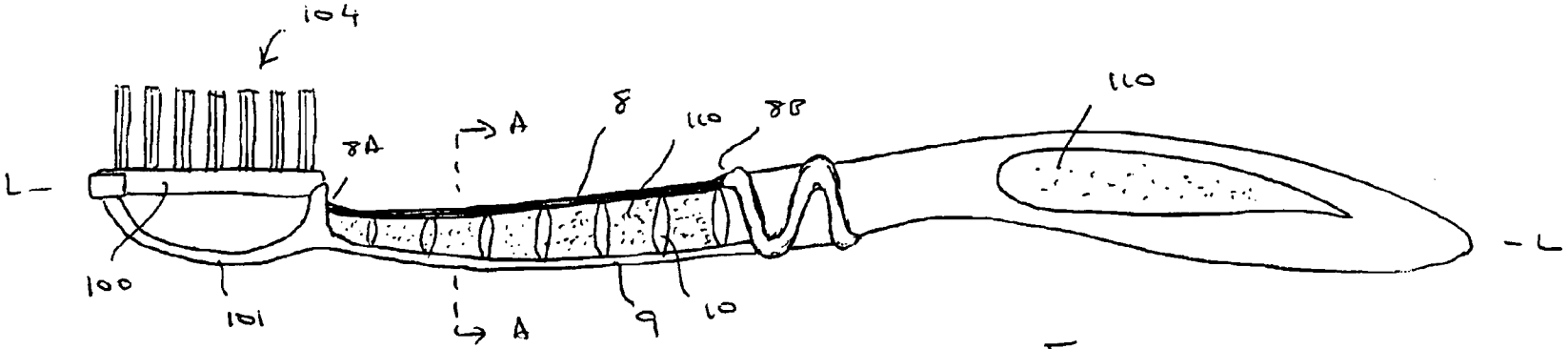

FIG. 10 a further example of a toothbrush of the invention

Figure 11:
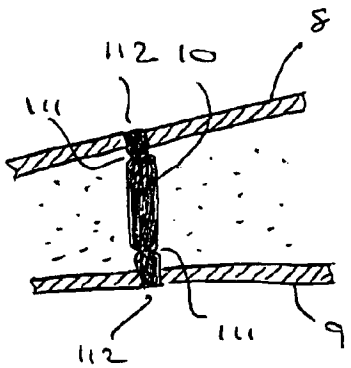

FIG. 11 a part of further example of a toothbrush of the invention.

Figure 12:
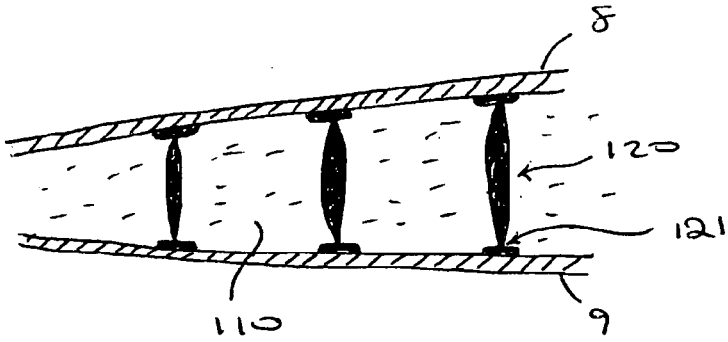

FIG. 12 a part of further example of a toothbrush of the invention.

Figure 13:
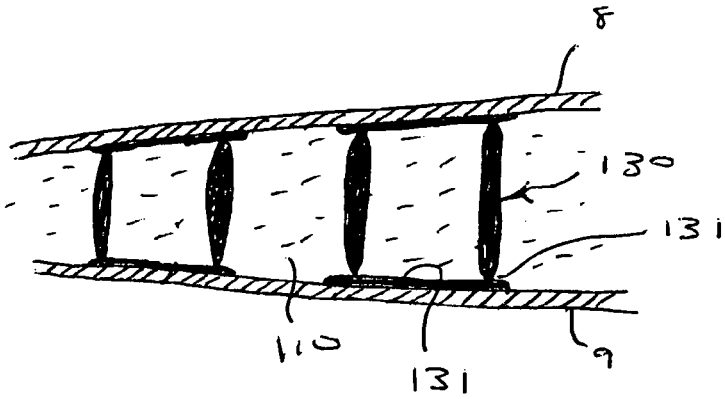

FIG. 13 a part of further example of a toothbrush of the invention.

Figure 14:
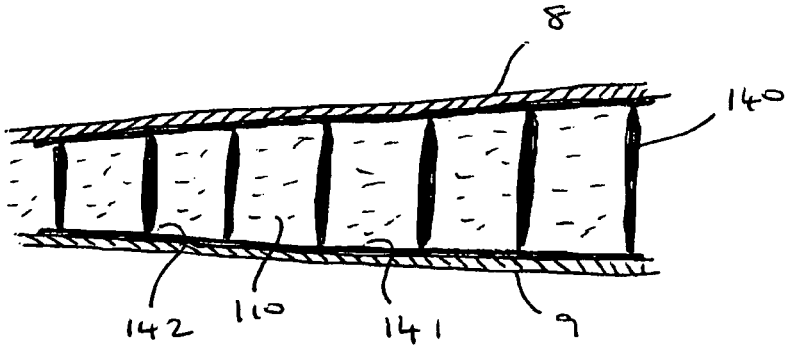

FIG. 14 a part of further example of a toothbrush of the invention.

Figure 15:
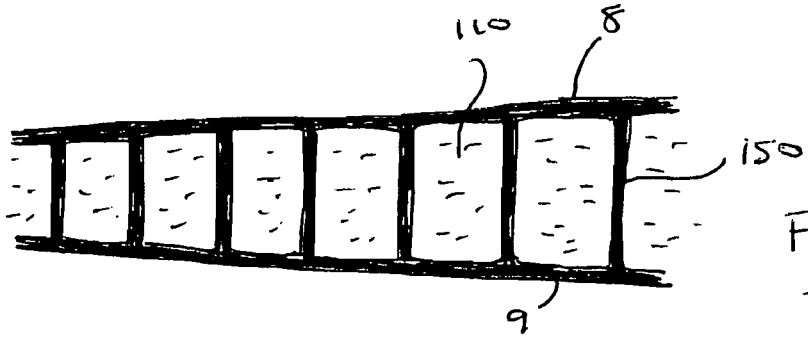

FIG. 15 a part of further example of a toothbrush of the invention.

First of all the general structure of a toothbrush according to the invention is described with reference to FIGS. 1 to 3.

FIG. 1 shows a first embodiment of a toothbrush according to the invention 1 in a diagrammatic 3-D view.

The toothbrush 1 has a handle area 2, a neck area 3 and a cleaning zone 4. The neck area 3 is located between the handle area 2 and the cleaning zone 4. On the cleaning zone 4 there are cleaning elements 5 which are only indicated diagrammatically in FIG. 1. Bristles, blades, fleece, elastomeric cleaning elements and all other suitable materials can be used as the cleaning elements 5. The toothbrush according to the invention 1 also has a deformable element 6 generally which in the example of an embodiment shown in FIG. 1 extends from the end of the handle 2 nearest the head 4 along the neck area 3 into the head 4.

The handle area 2 is provided for the user to hold the toothbrush 1 when brushing the teeth. The handle area 2 can be of any shape which allows a comfortable position of the toothbrush 1 in the user's hand, and meets the aesthetic requirements. The handle area can also be part of an electric toothbrush which replaces the cleaning movement by the user by a motorised movement. The user transmits the cleaning movement and the cleaning force through the handle area 2 of the toothbrush 1 in FIG. 1. The handle area of the embodiment presented in FIG. 1 has a thumb area 7 on which the user can rest his or her thumb when brushing his or her teeth and which is for example made of a particularly non-slip material.

The head 4 of the toothbrush 1 is distanced from the handle area 2 by the neck area 3, for example to allow easy cleaning of the back premolars, where the handle area 2 and the user's hand remain outside the mouth.

The head 4 of the toothbrush 1 carries the cleaning elements 5, which are pressed against the teeth during brushing by the cleaning force exerted by the user and clean them by means of a cleaning movement. The cleaning elements 5 can be secured to the cleaning zone 4 of the toothbrush 1 in any known manner. For example, the cleaning zone 4 can have holes (not shown) into which the cleaning elements 5, equipped with securing means, so-called anchors, are fitted. As in known toothbrushes, the cleaning elements 5 can be arranged at any angle to the cleaning zone 4 and at different angles to each other, and this aspect will be dealt with below. Alternatively, the cleaning zone 4 of the toothbrush 1 can also have a seating (not shown) in which a carrier element carrying the cleaning elements 5 is housed. Thus the carrier element with the cleaning elements 5 can be replaced and the rest of the toothbrush 1 can continue to be used. The carrier element is held in the seating for example by a snap-in device.

The deformable element 6 of the toothbrush according to the invention 1 is described more precisely below with reference to FIG. 2.

FIG. 2 shows a part of the toothbrush according to the invention 1 from FIG. 1 in a simplified diagrammatic side view.

The deformable element in FIG. 2 has a first flexible wing 8 arranged relatively closer to the cleaning zone 4 and a second such wing 9 arranged relatively further away from the cleaning zone 4, and also several guide elements 10 (four are shown, there may be more or less). The first and second wings 8 and 9 are held together moveably by the guide elements 10.

The wing 8 is made integrally with the handle 2 of a plastics material such as polypropylene of a grade as commonly used for toothbrushes. The wing 9 and the guide elements 10 are integrally made of a compressible elastic material of a hardness Shore D 120 or more.

The wings 8, 9 each have a contact end 11 and a handle end 12. At the contact ends 11 the tension and wings 8, 9 are connected firmly, e.g. by the known kind of bonding achievable between polypropylene and a thermoplastic elastic material. At the handle ends 12 facing towards the handle area 2 the wings 8, 9 are at a distance from each other, so that the deformable element 6 is essentially in the shape of a wedge. The handle ends 12 are connected firmly to the handle 2 of the toothbrush according to the invention 1, the wing 8 being made integrally of plastics material with the handle 2, the wing 9 by the known kind of bonding achievable between polypropylene and a thermoplastic elastic material. The wings 8 and 9 are each provided flexibly in a direction transverse to the longitudinal direction L, i.e. in the drawing plane of FIG. 2.

The wings 8, 9 form a wedge, which in longitudinal cut is defined by the ends 11, 12. Between the ends 11, 12 the wedge can be designed in any way, for example concave, convex or undulating. For example as seen in FIG. 1 the wings 8, 9 curve concavely on the side closest to the cleaning elements 5.

Between the wings 8, 9 the rib-shaped guide elements 10 run essentially linearly transverse to the longitudinal direction 'L' and these guide elements connect the tension wing 8 to the compression wing 9.

The guide elements 10 in FIGS. 1 to 3 are made of the same elastic material as wing 9.

In the embodiment illustrated in FIG. 2 the guide elements 10 are arranged at essentially equal longitudinal distances from each other. Alternatively the longitudinal distances between the individual guide elements 10 can vary and be provided differently within a deformable element 6.

FIG. 2A shows in more detail the construction of the ends of each guide element 10 adjacent to the wings 8, 9. The guide element 10 is integrally made and connected with the wing 9 in a connection point 14. At this point 14 the guide element 10 is thinned at 15 relative to the adjacent part of element 10 to provide a hinge. At the other end the element 10 is connected to wing 8 at point 16 by the known kind of bonding achievable between polypropylene and a thermoplastic elastic material, and at this point 16 the guide element 10 is thinned at 17 relative to the adjacent part of element 10 to provide a hinge. At point 18 on wing 8 is provided a raised bump or ridge to increase the area of contact between the element 10 and wing 8.

The guide elements 10 of the embodiment in FIG. 1 are provided as plate-shaped rib elements between the tension and compression wings 8, 9. The guide elements 10 divide the wedge space 19 into several separate sections 19A-19E.

In the embodiment in FIGS. 1 to 3 the essentially straight guide elements 10 are arranged at right angles to the longitudinal axis L-L which runs equidistantly between tension and compression wings 8, 9.

The deformable element 6 is housed in the wedge space 17, which is inside the toothbrush and runs in the longitudinal direction L. The wings 8, 9 of the deformable element 6 delineate the top and bottom of the wedge space 19.

Inside the space 19 and in particular inside the sections 19A-19E there is a further elastic material 110 as seen in FIG. 1A which affects the elasticity of the deformable element 6 and thus the deformability of the toothbrush 1. Elastic material 110 has a hardness Shore A 5-20. Suitably the material 110 may be transparent so that the internal structure of the space 19 may be seen.

In the embodiment illustrated in FIG. 1 the wedge space 19 extends as far as the thumb area 7 of the handle area 2. The material 110 of deformable element 6 facilitates hygiene so that space 19 is out of the reach of dirt and bacteria which might otherwise get inside the space 19.

In FIGS. 1 and 2 the toothbrush according to the invention 1 is represented in a resting or basic position in which no external forces are exerted on the toothbrush 1.

The advantageous deformation of the toothbrush according to the invention 1 during brushing of the teeth is described below with reference to FIG. 3. FIG. 3 shows the toothbrush 1 from FIG. 2 in a cleaning position during brushing of the teeth, when a cleaning force F is being exerted on the cleaning zone 4 of the toothbrush according to the invention 1. In the cleaning position the toothbrush 1 is held by a user by handle 2 and pressed against the surface of one or more teeth 20. From the tooth the cleaning force F acts as a counterforce on the cleaning zone 4. For a comparison between the cleaning position and the resting position, the contour of the deformable element 6 from FIG. 2 is shown in FIG. 3 as a dotted line.

In the cleaning position illustrated in FIG. 3 the cleaning zone 4 is curved against the cleaning force F compared with the resting position. In the process the contact point 15 of the cleaning force F is deflected by a deformation route 16 in relation to its position 15' in the resting position. The tension and compression wings 8, 9, which are linear without the effect of the cleaning force, bend under the cleaning force F against the direction of force F. The greater the cleaning force F, the more the wings 8, 9 bend against this direction in which the cleaning force acts. As shown in FIG. 3, in a comparison of the resting and cleaning positions, the contact point 15 is displaced in the direction of force F in relation to the ends 11, 12 of the wings 8, 9. The contact end 11 is moved in the longitudinal direction L by an offset 16' compared with the resting position. In the cleaning position the deformable element 6 has arched against the cleaning force in the shape of a fin. The guide elements 10 have twisted anticlockwise compared with the resting position and the connection points 14 of the tension and compression wings 8, 9 have been displaced in relation to each other in the longitudinal direction.

As a result of the deformation of the deformable element 6 represented in FIG. 3, the cleaning zone 4 of the toothbrush according to the invention 1 located on the tension wing 8 is also deformed essentially equally. This means that the cleaning elements 5 housed in the cleaning zone 4 are also deflected. As described above, the deformable element 6 bends around the contact point 15 of the cleaning force F in such a way that the cleaning zone 4 and the cleaning elements 5 are deformed concavely around this area. In this way the cleaning elements 5 which in FIG. 3 are arranged at the sides in the longitudinal direction L are deflected around the teeth 20 from which the cleaning force F derives, and thus are pushed into the interdental spaces during brushing.

As the guide elements 10 are twisted in the cleaning position in relation to the resting position, in the embodiment in FIG. 3 the distance between the wings 8 and 9 and thus the thickness of the toothbrush 1 is reduced. This is particularly advantageous because in this way it is easier to reach the difficult-to-reach premolars. Alternatively, the guide elements 10 can be arranged in the resting position at an angle of <90° to the axis L-L. This design of the resting position means that the twisting of the guide elements 10 in the cleaning position leads to an increase in the distance between the wing 9 and the wing 8. In the cleaning position the wings 8, 9 separate and the guide elements 10 do not, the deformable element is deformed as one unit.

FIG. 4 shows another embodiment of the toothbrush according to the invention 1, and in the description reference will only be made to the differences from the embodiment from FIGS. 1 to 3 described above. The toothbrush 1 in FIG. 4 has a smaller wedge space 19, but which may be filled with material 110 as above, and a smaller deformable element 6 than the embodiment in FIGS. 1 to 3. Wing 8 is made of plastic material and wing 9 is made of the elastic material as above. The same references as in the previous figures will be used for the same parts which are similar or identical in structure and/or function to parts in the previous embodiment. The deformable element 6 extends essentially only in the cleaning area 4 of the toothbrush 1, so that the neck 3 is a solid construction with handle 2. Otherwise the embodiment in FIG. 4 essentially corresponds to the embodiment in FIGS. 1 to 3. Naturally other embodiments are also possible where the deformable element 6 and the wedge shape 19 are even smaller than in FIG. 4 or larger than in FIG. 1, for example extending right into the handle area 2.

In the FIGS. 5 to 8 described below alternative embodiments of the toothbrush according to the invention 1 are represented which differ in different versions of the deformable element 6 and the wedge space 19. For the sake of simplicity, FIGS. 5 to 8 are diagrammatic and each show the part of the toothbrush according to the invention 1 which differs from FIGS. 1 to 3.

For the embodiments in FIGS. 5 to 8 only the differences from the embodiment in FIGS. 1 to 3 will be dealt with. The same references as in the previous figures will be used for the same parts which are similar or identical in structure and/or function to parts in the previous embodiment.

FIG. 5 shows a further embodiment of a toothbrush according to the invention 1, in which the cross-section of the deformable element 6 is made up of a wedge-shaped section 6A and a rectangular section 6B in which the wings 8, 9 do not taper. Wing 8 is made of plastic material and wing 9 and guide elements 10 are made of the elastic material as above. The space 19 may contain a further elastic material 110 as above. In the rectangular section 6*a* the lengths of the guide elements 10 are essentially the same, and in the wedge-shaped section 6*b* the lengths of the guide elements 10 diminish in the direction towards the contact end 11.

By combining the rectangular section 6B with the wedge-shaped section 6A the curving of the deformable element 6 in the cleaning position is reduced compared with the embodiment represented in FIG. 2 with the same cleaning force F.

In the embodiment in FIG. 6 which is represented in solid lines for the cleaning position and in dotted lines for the resting position, the cross-section of the deformable element 6 is formed as a wedge which is wavy on both sides. The wavy form can be achieved by wavy wings 8, 9. Wing 8 is made of plastic material and wing 9 and guide elements 10 are made of the elastic material as above. The space 19 may contain a further elastic material 110 as above. The wavy cross-section of the deformable element 6 means that the cleaning zone 4 and the cleaning elements 5 are also wavy. This can lead to a particularly responsive shape or to increased or reduced curving of the toothbrush 1 in the cleaning position. The wedge-shaped deformable element 6 can be convex, concave or in any suitable shape. Irrespective of the shape, the deformable element 6 bends against the cleaning force in the cleaning position. The cleaning zone 4 in the cleaning position is displaced essentially in parallel, retaining the axis of rotation of the cleaning movement.

FIG. 7 shows a further advantageous embodiment of the toothbrush according to the invention 1 in a perspective view. In this embodiment the wing 8 of the toothbrush according to the invention 1 has two deformable elements 6*a*, 6*b* lying alongside each other. The individual deformable elements 6*a*, 6*b* are each provided according to one of the embodiments described above. On each of the deformable elements 6*a*, 6*b* there are separate cleaning zones 4*a*, 4*b* on which cleaning elements 5 are housed. Wing 8 is made of plastic material and wing 9 and guide elements 10 are made of the elastic material as above. The space 19 may contain a further elastic material 110 as above, but omitted from FIG. 7 for clarity.

FIG. 8 shows a further embodiment of a toothbrush according to the invention 1 where the wing 8 of the deformable element 6 has two elements 8A, 8B lying alongside each other on opposite sides of the longitudinal direction L-L and a wing 9. Wing 8 is made of plastic material and wing 9 and guide elements 10 are made of the elastic material as above. The space 19 may contain a further elastic material 110 as above. The two elements 8A, 8A and the wing 9 are connected tightly to each other at their contact end 11, as in the embodiments described above.

The wing 9 is connected to the element 8A by linear connecting elements 10A and to the element 8B by separate, also linear, connecting elements 10B. Alternatively, the two elements 8A, 8B can also be connected to the wing 9 by connecting elements which are V-shaped as seen along the longitudinal direction. Elements 8A and 8B are made of plastic material and wing 9 and guide elements 10 are made of the elastic material as above. The space 19 may contain a further elastic material 110 as above, but omitted from FIG. 8 for clarity.

In the embodiment represented in FIG. 8 there are cleaning zones 4A and 4B on the two elements 8A, 8B. For the sake of clarity, the cleaning elements are not shown in the representation in FIG. 8.

FIG. 9 shows a side, part sectioned, view of a further embodiment of the toothbrush 1 of the invention, in which the toothbrush has wings 8, 9 disposed as described above. Wing 8 comprises two wings 8A, 8B side by side across the widthways direction of the toothbrush (perpendicular to the longitudinal direction L-L), perpendicular to the plane of the drawing, closer to the bristles 5 and made of plastic material, and wing 9 and guide elements 10 are made of the elastic material as above. The arrangement of the wings 8A, 8B is more clearly seen in FIG. 9A being the cross section at A-A in FIG. 9. FIG. 9A shows how the guide element 10 is generally "V" shaped as seen looking in the longitudinal direction L-L, and is embedded in the elastic material 110. The space 19 between wings 8, 9 contains a further elastic material 110 as above. The wing 9 is connected at its two ends 9A, 9B to the plastic material of the handle 2 and to the end of the wing 8 by the known kind of bonding achievable between polypropylene and a thermoplastic elastic material. The toothbrush of FIG. 9 incorporates a flexibility-modifying region 91 of generally known type e.g. a region of folds as disclosed in EP-A-0336641, and the plastic material of the handle 2 incorporates a cavity 92 of a generally known type which may be filled with the elastic material 110. In the head 94 of the toothbrush of FIG. 9 the wing 8 is formed into a thin plastics material plate 96 in which are set the bristles 95 shown in more detail in FIG. 9B. The plate 96 comprises plural relatively thinned regions 97 being widthways aligned grooves each of which can function as a hinge. There are holes 98 through the plate 96, and the ends 99 of the bristles 95, fused into a thickened "mushroom" extend through these holes 98 to be embedded in the further material 110. This enables the bristles to advantageously bounce as they on the material 110 as they experience the forces of tooth brushing.

In FIG. 9C an alternative, more conventional way of mounting the bristle tufts 95 is shown in which tuft socket holes 910 are pre-formed in the plate 96 and the tufts 95 of bristles are retained therein using conventional metal "anchors" 911.

Figure 10A:
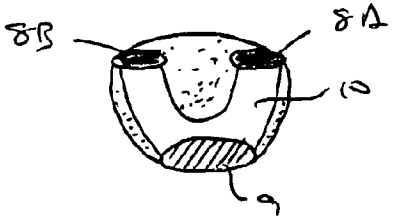

FIG. 10 shows a side view of a further embodiment of the toothbrush 1 of the invention, in which the toothbrush has wings 8, 9 disposed as described above. Two wings 8A, 8B are provided side by side across the widthways direction of the toothbrush (perpendicular to the longitudinal direction L-L), perpendicular to the plane of the drawing, closer to the bristles 5. The wings 8A, 8B are made of a compressible elastic material as used above. Wing 9 and guide elements 10 are made integrally of the plastic material e.g. polypropylene, and are connected to the wing 8 by the known kind of bonding achievable between polypropylene and a thermoplastic elastic material. Guide elements 10 in FIG. 10 have thinned regions adjacent to their ends at which they are joined to wigs 8, 9 analogous in shape to those shown in FIG. 1. The arrangement of the wings 8A, 8B is more clearly seen in FIG. 10A being the cross section at A-A in FIG. 9. FIG. 10A shows how the guide element 10 is generally "V" shaped as seen looking in the longitudinal direction L-L, and is embedded in the elastic material 110. The space 19 between wings 8, 9 contains a further elastic material 110 as above. The wings 8A, 8B are connected at their two longitudinal ends to the plastic material of the handle 2 and the end of the wing 9 by the known kind of bonding achievable between polypropylene and a thermoplastic elastic material. The head 104 of the toothbrush is of a known type comprising bristles 5 set in a thermoplastic elastomer pad 100 supported by the "bow" structure 101, of the type disclosed in WO-A-2005/084486.

FIG. 11 shows a side sectional view of part of a toothbrush which has wings 8, 9 disposed as above and which are both made of plastics material e.g. polypropylene. The guide element 10 between them is made of a compressible elastic material as described with respect to FIGS. 1 to 10 above. The guide element 10 has thinned regions 111 adjacent to the ends at which it is connected to wings 8, 9, analogous to the constructions described above. The guide element 10 of FIG. 11 has been formed in situ between wings 8, 9 by injection moulding of the guide element 10, and is set in apertures 112 in the wings 8, 9.

FIGS. 12-15 show four alternative constructions of part of a deformable member of a toothbrush of the invention.

In FIG. 12, wings 8, 9 are disposed as above and both made of plastics material e.g. polypropylene. The guide element 120 between them is made of a relatively more rigid compressible elastic material as described with respect to FIGS. 1 to 11 above. The guide element 120 has thinned regions 121 adjacent to the ends at which it is connected to wings 8, 9, analogous to the constructions described above. The guide element 120 of FIG. 12 has been formed by injection moulding in situ between wings 8, 9 by injection moulding of the guide element 120, and is welded to the wings 8, 9. The spaces between the wings 8, 9 and guide elements 10 are filled with a further material part being a compressible elastic further material 110 less rigid than the material of the elements 120.

In FIG. 13, wings 8, 9 are disposed as above and are both made of plastics material e.g. polypropylene. The guide element 130 between them is made of a compressible elastic material as described with respect to FIGS. 1 to 11 above. Longitudinally adjacent pairs of guide elements 130 are integrally linked by bridges 131, forming a box-like structure, and each guide element 130 has a thinned region 132 adjacent to the bridges 131 analogous to the constructions described above. The integral unit of guide element 130 and bridges 131 of FIG. 13 has been formed by injection moulding in situ between wings 8, 9 by injection moulding, and each bridge 131 is welded to the wings 8, 9 as a result of this injection moulding process. The spaces between the wings 8, 9 and guide elements 130 are filled with a compressible elastic further material 110 less rigid than that of which the elements 130 are made.

In FIG. 14, wings 8, 9 are disposed as above and are made of plastics material e.g. polypropylene. The guide elements 140 between them are made of a compressible elastic material as described with respect to FIGS. 1 to 11 above. Longitudinally adjacent guide elements 140 are linked by continuous bridges 141, in a ladder-like structure, and each guide element 140 has a thinned region 142 adjacent to the bridges 141 analogous to the constructions described above. The integral unit of guide elements 140 and bridges 141 has been formed by injection moulding in situ between wings 8, 9 by injection moulding. Each bridge 141 is welded to the wings 8, 9 as a result of this injection moulding process. The spaces between the bridges 141 and guide elements 140 are filled with a compressible elastic further material 110 less rigid than that of which the elements 140 are made.

In FIG. 15, wings 8, 9 are disposed as above and together with guide elements 150 between them are made of a compressible elastic material as described with respect to FIGS. 1 to 11 above. The spaces between the wings 8, 9 and guide elements 150 are filled with a compressible elastic further material 110 less rigid than that of which the elements 150 are made.

Naturally, further embodiments of the toothbrush according to the invention 1 in addition to those represented in the figures are possible. For example, the toothbrush according to the invention 1 can be provided with an actuator, e.g. an electric motor, which initiates a movement in at least one wing 8, 9, in order to replace or support the cleaning movement by the user.

The invention claimed is:

1. A toothbrush with at least one cleaning zone on which bristles are arranged, to be pressed against the teeth during use with a cleaning force, and with at least one deformable element by which the cleaning zone can be adapted to the shape of the tooth surface by the cleaning force, where the deformable element has at least a first flexible wing arranged relatively closer to the cleaning zone and a second such wing arranged relatively further away from the cleaning zone, and also at least one guide element comprising an element bridging between the wings and connected to the wings of each end of the guide element, and where the first and second wings are held together moveably by the guide element, the wings forming a wedge, being closer together at one end and further distanced from each other at the other end, characterised in that at least one of said wings, and/or at least one guide element is made of a compressible elastic material and between the wings there is a space in which there is a further compressible elastic material which is less rigid than the compressible elastic material of which the wing or guide element is made.

2. The toothbrush according to claim 1 characterised in that at least one of said wings, and/or at least one of said guide elements is made of a compressible elastic material, and at least one of said wings, and/or at least one of said guide elements is made of a plastics material.

3. The toothbrush according to claim 1 wherein the wings form a wedge in which they are joined together at a point relatively further from the handle, and are further distanced from each other at a point relatively closer to the handle, the wedge-shape tapering in the longitudinal direction from the handle, narrowing toward the cleaning zone.

4. The toothbrush according to claim 1 wherein the first flexible wing arranged relatively closer to the cleaning zone is made of plastics material, and the second such wing arranged relatively further away from the cleaning zone is made of compressible elastic material.

5. The toothbrush according to claim 1 wherein the first flexible wing arranged relatively closer to the cleaning zone is made of compressible elastic material, and the second such wing arranged relatively further away from the cleaning zone is made of plastics material.

6. The toothbrush according to claim 1 wherein both the first flexible wing arranged relatively closer to the cleaning zone and the second wing arranged relatively further away from the cleaning zone are made of plastics material, and at least one of said guide elements is made of a compressible elastic material.

7. The toothbrush according to claim 1 wherein the first flexible wing arranged relatively closer to the cleaning zone is made of plastics material, and the second such wing arranged relatively further away from the cleaning zone is made of compressible elastic material, and at least one of said guide elements is made of a compressible elastic material.

8. The toothbrush according to claim 1 wherein the first flexible wing arranged relatively closer to the cleaning zone is made of compressible elastic material, and the second such wing arranged relatively further away from the cleaning zone is made of plastics material, and at least one of said guide elements is made of a compressible elastic material.

9. The toothbrush according to claim 1 wherein both the first flexible wing arranged relatively closer to the cleaning zone and the second such wing arranged relatively further away from the cleaning zone are made of compressible elastic material, and at least one of said guide elements is made of a compressible elastic material.

10. The toothbrush according to claim 1 wherein both the first flexible wing arranged relatively closer to the cleaning zone and the second such wing arranged relatively further away from the cleaning zone are made of compressible elastic material, and at least one of said guide elements is made of a compressible elastic material.

11. The toothbrush according to claim 1 wherein a wing and one or more guide element are made integrally of the same compressible elastic material.

12. The toothbrush according to claim 1 characterized in that the compressible elastic material has a hardness of Shore D 100 or more.

13. The toothbrush according to claim 1 characterised in that the further elastic material has a hardness of Shore A 5-20.

* * * * *